US006578325B2

(12) United States Patent
Henderson

(10) Patent No.: US 6,578,325 B2
(45) Date of Patent: Jun. 17, 2003

(54) ROOF VALLEY AIR INTAKE VENT

(76) Inventor: John C. Henderson, 335 Summit Rd., Springfield, PA (US) 19008

( * ) Notice: Subject to any disclaimer, the term of this patent is extended or adjusted under 35 U.S.C. 154(b) by 0 days.

(21) Appl. No.: 09/971,722

(22) Filed: Oct. 4, 2001

(65) Prior Publication Data

US 2002/0066243 A1 Jun. 6, 2002

Related U.S. Application Data

(60) Provisional application No. 60/238,055, filed on Oct. 5, 2000.

(51) Int. Cl.[7] ..... F24F 7/02
(52) U.S. Cl. ..... 52/199; 52/198
(58) Field of Search ..... 52/57, 199, 198

(56) References Cited

U.S. PATENT DOCUMENTS 3,236,170 A * 2/1966 Meyer et al. ..... 454/365
3,949,657 A * 4/1976 Sells ..... 454/365
4,803,813 A * 2/1989 Fiterman ..... 156/227
5,094,041 A * 3/1992 Kasner et al. ..... 454/365
5,304,095 A * 4/1994 Morris ..... 454/365
5,947,817 A * 9/1999 Morris et al. ..... 454/365
6,361,434 B1 * 3/2002 Brandon ..... 454/365

* cited by examiner

*Primary Examiner*—Carl D. Friedman
*Assistant Examiner*—Basil Katcheves
(74) *Attorney, Agent, or Firm*—John S Munday

(57) ABSTRACT

A roof vent device for providing air intake to the valley of a roof where the valley of the roof extend from the soffit to the roof ridge. The device comprises a support surface mounted in contact with valley flashings on the roof. The support surface extends axially along the hip beam of the roof and joined by the jack rafters. At least one additional layer not as wide as the support surface but axially equal in length increase the space between the hip beam and the device's central axis. The additional layers do not extend as far as central axis of the support surface, thus creating an open space between the hip beam and the support surface. A pivot point in the central axis of the support surface permits the support surface to conform to any valley flashing used.

18 Claims, 1 Drawing Sheet

ROOF VALLEY AIR INTAKE VENT

This application claims the benefit of Provisional application Ser. No. 60/238,055, filed Oct. 5, 2000.

FIELD OF THE INVENTION

This invention relates to a roof vent device for providing air intake to roof ventilating systems. More particularly, the invention relates to a vent for the valley of a roof, which is the inside corner on a roof, wherein a maximum volume of air is brought in.

BACKGROUND OF THE INVENTION

Ventilation is conventionally provided in residential and light commercial buildings through the use of soffit vents. The soffit is the band of ceiling-like area covering the bottom of the roof overhang. A soffit vent is a strip vent or the like installed in the soffit to ventilate the attic and the roof to provide air circulation in this otherwise enclosed space. However, some buildings with soffit vents have been ineffectual due to clogging of the vents, due to insulation or accumulation of leaves and the like that cover the vent openings, or when paint is applied to the structure. In many cases there is not enough air introduced into the enclosed area to provide adequate venting.

A variety of devices have been proposed to supply air to the attic, including louvered vents or ridge vents located in the portion of the structure at or near the ridge of the roof. Also used are gable vents and turbines located on the roof structure. None of these designs optimize air ventilation in the attic. Louvered vents operate only on the top of the roof. Turbines require a hole in the shingles, increasing risk of water penetration. Also, turbines require energy for operation.

At the present time, roof vents are mounted along the roof ridge to provide a vent from the attic area of a house or other structure, to reduce the build-up of heat in the summer. While venting roofs is a necessary part of house construction, use of auxiliary vents are not cost effective. Specifically, the use of separate exhaust fans and vents adds significant cost to the dwelling and have considerably shorter effective life-spans.

U.S. Pat. No. 5,099,627 provides a ventilated roof construction that permits air circulation beneath shingles, thus stalling deterioration. Other proposals have focused on the roof ridge using tapered designs that are exposed to the outside of the building. No practical efforts have been effective in aiding venting without exposing the device to be employed to the outside environment.

It would be a great advantage if an improved vent device could be provided that would reduce high summer temperatures in attics, thus increasing shingle life and decreased air conditioner usage.

Another advantage would be achieved if damage from the formation of ice dams on roofs during the winter months would be avoided, thus preventing freeze/thaw situations aggravated by attic heat It is therefore an object of this invention to provide an improved roof vent for use in an attic.

Another object is to provide a vent device that is easy to install in conventional roof construction, utilizing conventional roof decking construction.

Yet another object of the present invention is to provide a vent device maximizing the amount of air brought into an attic in both summer and winter, without the use of additional power or energy.

Other objects will appear hereinafter.

SUMMARY OF THE INVENTION

It has now been discovered that the above and other objects of the present invention may be accomplished in the following manner. The unique aspect of this invention is the use of a roof valley vent.

The device of the present invention is to be used at that point in the roof where the valley or inside corners of a roof extend from the soffit to the roof ridge.

The device functions such that when used at the valley, a maximum amount of air is introduced into the attic and the least amount of heat contrast between the inside and outside of the roof is achieved.

The material used to construct this valley vent device comprises a larger support surface that is mounted in contact with the standard valley flashings conventionally used in building construction. The support surface extends axially along the hip beam of the roof where it is joined by the jack rafters. At least one and preferably two additional layers not as wide as the support surface but axially equal in length increase the space between the hip beam and the central axis of the device. The additional layers do not extend as far as the central portion or central axis of the support surface, thus creating an open space between the hip beam and the support surface. Located at this central axis is a pivot point in the support surface, so that the support surface is able to pivot to conform to any valley flashing used. The angle is not important, other than it is necessary to provide a flush surface for engagement with the valley flashing.

The present invention is admirably suited for buildings in which a cathedral interior ceiling exists, since these valley constructions have herein been found to be particularly critical in achieving effective venting of the attic associated with the cathedral ceiling.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
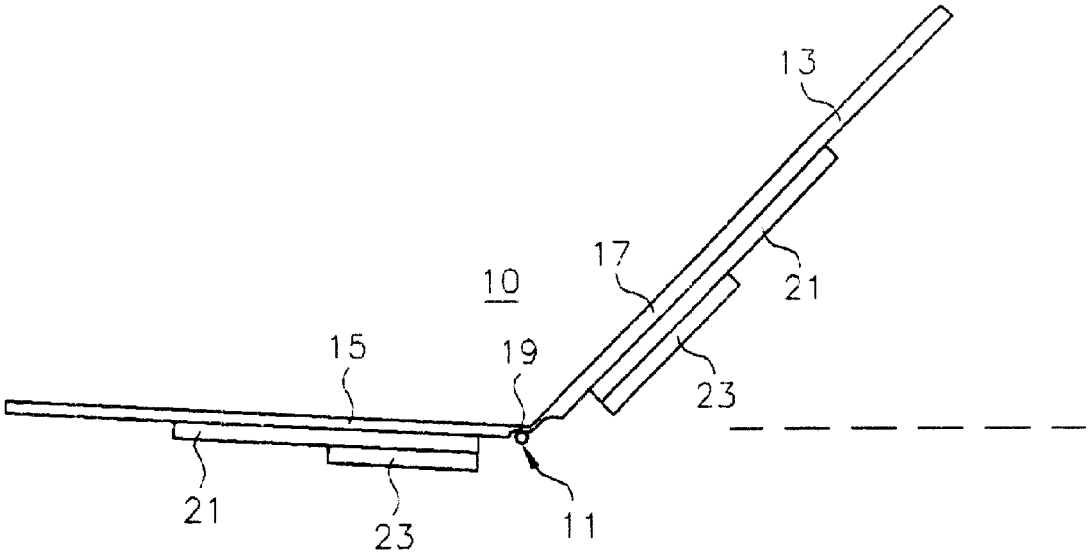
FIG. 1 is a cross sectional view of the design of the present invention, with the device as it would be installed shown in solid lines and bending to conform to the valley flashing also illustrated.

As shown in FIG. 1, the device 10 is a layered flexible device having a longitudinal axis 11, into the drawing, and extends for practical lengths suitable for ease of transportation and installation A support surface 13 conforms to the longitudinal length of axis 11 and has a width of practical size for use with a valley flashing. One foot in width on each side 15 and 17 of the center axis 11 is a suitable width.

Figure 2:
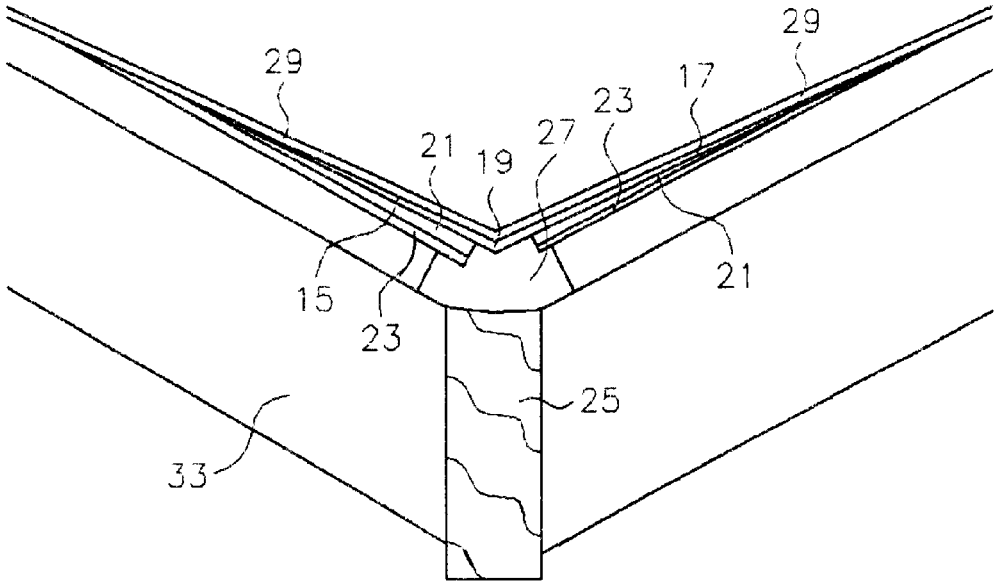
FIG. 2 is a cross sectional view of the device installed on the valley of a roof structure.

The support surface has a pivot point 19, formed for example by a routed flute, about which the two sides 15 and 16 of support surface pivot, as shown by angle A. Attached to support surfaces 15 and 17 is at least one spacer. In FIGS. 1 and 2, there are two spacers, 21 and 23, respectively, which are of the same length as surfaces 15 and 17, but have decreasingly narrow widths. It is contemplated that one, two, three or more spacers may be used. The importance of the spacer is to support the support surfaces 15 and 17 and to space the device from hip beam 25 to form open space 27, as seen in FIG. 2. Open space 27 is designed to be sufficient to provide maximum air intake into the attic, thus accomplishing the objects of this invention.

The device is mounted under standard valley flashings 29 and leaves small spaces 31 between the hip beam 25 and jack rafters 33. It is, of course, important that spaces 31 communicate with space 27.

The entire device can be manufactured in a variety of ways. The preferred embodiment comprises the use of low density polyethylene strips molded to form the individual components of support surface 13, with the region at pivot point 19 thinner, at least after routing to form the pivot point itself, as well as spacers 21 and 23. Alternatively the entire device can be molded, but dies for such a molding operation would be more complicated. The spacers 21 and 23 are suitably bonded to the sides 15 and 17 by a permanent adhesive, not shown.

While particular embodiments of the present invention have been illustrated and described, it is not intended to limit the invention to any specific embodiment. The dimensions and materials given are for the preferred embodiment and are not to be construed as limitations on the scope of this invention. The description of the invention is not intended to limit the invention.

What is claimed is:

1. A roof vent device or providing air intake to the valley of a roof in combination with a valley flashing, hip beam and jack rafters, comprising:

a support surface axing a central axis and sized for contact with a valley flashing and mounted under said flashing on a roof and in contact with said jack rafters, said support surface extending axially along the hip beam of the roof and joined to the jack rafters for the length of said central axis without providing an opening between said rafter and said flashing at the ends of said flashing;

at least one additional layer having a smaller width than said support surface and axially equal in length thereto for increasing space between said hip beam and said central axis without providing air access to the outside, said at least one additional layer being mounted on said support surface along the length and on the side away from said flashing thereof and spaced from said central axis to create an open space between said hip beam and said support surface; and a pivot point formed along said central axis of said support surface to permit said support surface to conform to said valley flashing.

2. The device of claim 1, wherein at least a second additional layer is mounted on said one additional layer, said second additional layer having a smaller width than said one additional layer and having an axial length substantially equal to said support surface.

3. The device of claim 2, wherein said second additional layer is mounted on said one additional layer to align said first and second additional layers to be equally spaced from said central axis of said support surface.

4. The device of claim 1, wherein said valley flashing extends from the soffit to the roof ridge.

5. The device of claim 1, wherein said at least one additional layer is bonded to said support surface with an adhesive.

6. The device of claim 1, wherein said second additional layer is bonded to said one additional layer with an adhesive.

7. A roof vent device for providing air intake to the valley of a roof in combination with a valley flashing, hip beam and jack rafters, comprising:

support surface means sized for contact with a valley flashing and mounted under said flashing on a roof and in contact with said jack rafter and having central axis, said support surface extending axially along the hip beam of the roof and joined to the jack rafters for the length of said central axis without providing an opening between said rafter and said flashing at the ends of said flashing;

at least one additional layer means for increasing space between said hip beam and said central axis without providing air access to the outside and having a smaller width than said support surface means and axially equal in length thereto said at least one additional layer means being mounted on said support surface means along the length thereof and on the side way from said flashing and spaced from said central axis to create an open space between said hip beam and said support surface; and pivot point means formed along said central axis of said support surface for permitting said support surface means to conform to said valley flashing.

8. The device of claim 7, wherein at least a second additional layer means for increasing space between said hip beam and said central axis is mounted on said one additional layer means, said second additional layer means having a smaller width than said one additional layer means and having an axial length substantially equal to said support surface means.

9. The device of claim 8, wherein said second additional layer means is mounted on said one additional layer means to align said first and second additional layer means to be equally spaced from said central axis of said support surface means.

10. The device of claim 7, wherein said valley flashing extends from the soffit to the roof ridge.

11. The device of claim 7, wherein said at least one additional layer means is bonded to said support surface means with an adhesive.

12. The device of claim 7, wherein said second additional layer means is bonded to said one additional layer with an adhesive.

13. A method for pro ding air intake to the valley of a roof having a valley flashing, a hip beam and jack rafters, comprising the steps of:

mounting a roof vent device to said roof, said device including a support surface having central axis on a valley flashing and mounted under said flashing on a roof and in contact with said jack rafters, said support surface extending axially along the hip beam of the roof and joining said support surface to the jack rafters for the length of said central axis without providing an opening between said rafter and said flashing at the ends of said flashing; at least one additional layer having a smaller width than said support surface and axially equal in length thereto for increasing space between said hip beam and said central axis without providing air access to the outside, said at least one additional layer being mounted on said support surface along the length thereof and on the side away from said flashing and spaced from said central axis to create an open space between said hip beam and said support surface; and a pivot point formed along said central axis of said support surface to permit said support surface to conform to said valley flashing;

said roof vent device forming a space to provide a maximum amount of air into the roof and the least amount of heat contrast between the inside and outside of the roof is achieved.

14. The method of claim 13, wherein at least a second additional layer is mounted on said one additional layer, said second additional layer having a smaller width than said one additional layer and having an axial length substantially equal to said support surface.

15. The method of claim 14, wherein said second additional layer is mounted on said one additional layer to align said first and second additional layers to be equally spaced from said central axis of said support surface.

16. The method of claim 13, wherein said valley flashing extends from the soffit to the roof ridge.

17. The method of claim 13, further including the step of bonding said at least one additional layer to said support surface with an adhesive.

18. The method of claim 13, further including the step of bonding said second additional layer to said one additional layer with an adhesive.

* * * * *